US011516592B2

(12) United States Patent
Song et al.

(10) Patent No.: US 11,516,592 B2
(45) Date of Patent: Nov. 29, 2022

(54) SOUNDING DEVICE

(71) Applicant: AAC Microtech (Changzhou) Co., Ltd., Changzhou (CN)

(72) Inventors: Wei Song, Shenzhen (CN); Xin Jin, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,501

(22) Filed: Nov. 24, 2021

(65) Prior Publication Data

US 2022/0174420 A1 Jun. 2, 2022

(30) Foreign Application Priority Data

Nov. 30, 2020 (CN) ..... 202022830627.3

(51) Int. Cl.

| | |
|---|---|
| ***H04R 9/06*** | (2006.01) |
| ***H04R 9/04*** | (2006.01) |
| ***H04R 9/02*** | (2006.01) |
| ***H04R 31/00*** | (2006.01) |

(52) U.S. Cl.

CPC ..... *H04R 9/06* (2013.01); *H04R 9/02* (2013.01); *H04R 9/025* (2013.01); *H04R 9/04* (2013.01); *H04R 31/006* (2013.01); *H04R 2400/11* (2013.01); *H04R 2499/11* (2013.01)

(58) Field of Classification Search

CPC ..... H04R 2400/11; H04R 2499/11; H04R 31/006; H04R 9/02; H04R 9/025; H04R 9/04; H04R 9/06

See application file for complete search history.

(56) References Cited

U.S. PATENT DOCUMENTS

| | | | | |
|---|---|---|---|---|
| 10,820,106 | B2 * | 10/2020 | Gu | H04R 9/025 |
| 11,032,649 | B2 * | 6/2021 | Shao | H04R 9/06 |
| 2020/0213720 | A1 * | 7/2020 | Wu | H04R 1/2834 |

* cited by examiner

*Primary Examiner* — Huyen D Le
(74) *Attorney, Agent, or Firm* — W&G Law Group

(57) ABSTRACT

A sounding device includes a positioning bracket, a vibration system fixed to the positioning bracket, and a magnetic circuit system driving the vibration system to vibrate to generate sound. The vibration system includes a diaphragm fixed to the positioning bracket and a voice coil driving the diaphragm to vibrate. The magnetic circuit system includes a yoke, a main magnet component, and auxiliary magnet components. The yoke includes a yoke body, yoke extension walls, and yoke sidewalls. The auxiliary magnet component is fixed on the yoke extension wall. The main magnet component is sequentially spaced apart from the auxiliary magnet component and the yoke sidewall to form the magnetic gap. The positioning bracket is made of a metal material. One side of the auxiliary magnet component away from the yoke is fixed to the positioning bracket by laser spot welding. The sounding device has a better reliability.

9 Claims, 5 Drawing Sheets

A–A

B-B

SOUNDING DEVICE

TECHNICAL FIELD

The disclosure relates to the field of acoustoelectric, and in particular, to a sounding device.

BACKGROUND

With the advent of the Internet era, the number of mobile terminal devices continues to rise. Among mobile devices, mobile phones are undoubtedly the most common and portable mobile terminal devices. Sounding devices configured to play music and other sounds are widely used in the mobile terminal devices such as mobile phones. A vibration system in the sounding device is particularly important, and the whole sounding device vibrates and sounds through the vibration system.

In the related art, the sounding device includes a frame, a vibration system fixed to the frame and a magnetic circuit system configured to drive the vibration system to vibrate to generate sound and having a magnetic gap. The vibration system includes a diaphragm and a voice coil inserted in the magnetic gap to drive the diaphragm to vibrate. The vibration system includes a yoke and a magnet component fixed to interior of the yoke and spaced apart from the yoke to form the magnetic gap. The yoke is fixed to the frame.

However, that the yoke is fixed to the frame may cause structural interference of the yoke with other components, resulting in poor reliability of the sounding device.

Therefore, there is a need to provide a sounding device to solve the above problems.

SUMMARY

An objective of the disclosure is to provide a sounding device with better reliability.

The disclosure provides a sounding device. The sounding device includes a positioning bracket, a vibration system fixed to the positioning bracket, and a magnetic circuit system configured to drive the vibration system to vibrate to generate sound. The vibration system includes a diaphragm fixed to the positioning bracket and a voice coil configured to drive the diaphragm to vibrate. The magnetic circuit system includes a yoke, a main magnet component fixed to the yoke, and auxiliary magnet components arranged at two opposite sides of the main magnet component and spaced apart from the main magnet component to form a magnetic gap, and the voice coil is inserted in the magnetic gap. The yoke includes a yoke body, yoke extension walls, and yoke sidewalls. Two opposite sides of the yoke body extend to form the yoke extension walls, respectively, and another two opposite sides of the yoke body are bent and extend toward the diaphragm to form the yoke sidewalls, respectively. The auxiliary magnet components are respectively fixed to the yoke extension walls, and the main magnet component is sequentially spaced apart from the auxiliary magnet components and the yoke sidewalls to form the magnetic gap. The positioning bracket is made of a metal material, and one side of each of the auxiliary magnet components away from the yoke is fixed to the positioning bracket by laser spot welding.

As an improvement, each of the yoke extension walls is formed by extending along a vibration direction perpendicular to the vibration system.

As an improvement, the positioning bracket includes a positioning bracket body and positioning slots. Sides of the positioning bracket body close to the magnetic circuit system are recessed towards the diaphragm to form the positioning slot, respectively. The positioning slots are in one-to-one correspondence to the auxiliary magnet components, and one end of one of the auxiliary magnet components away from one of the yoke extension walls is received in one positioning slot of the positioning slots and is fixed to a bottom surface of the one positioning slot by laser spot welding.

As an improvement, the positioning bracket is in a rectangular shape and includes two long frames opposite to each other and two short frames opposite to each other. The positioning slots are arranged on the long frames, the vibration system further includes a framework fixed to one side of the diaphragm close to the magnetic circuit system and an auxiliary diaphragm component. The voice coil is fixed to the diaphragm through the framework. The auxiliary diaphragm component has one end fixed to one side of one of the long frames away from the diaphragm and another end elastically supporting the framework.

As an improvement, the positioning bracket body includes a first sidewall in a ring shape and forming the positioning slots, a second bottom wall, a third bottom wall, and fourth inclined walls. A portion of the first sidewall located at each of the positioning slots is bent and extends towards the yoke to form the second bottom wall. An inner side of the first sidewall is bent and extends towards the yoke to form the third bottom wall. Two opposite ends of the second bottom wall extend towards the third bottom wall and then are connected to the third bottom wall to from the fourth inclined walls, respectively. A spacing distance between the second bottom wall and the yoke body is greater than a spacing distance between the third bottom wall and the yoke body. The second bottom wall and two adjacent ones of the fourth inclined walls define one of the positioning slots, and one end of one of the auxiliary magnet components away from one of the yoke extension walls is fixed to the second bottom wall by laser spot welding. The third bottom wall is arranged corresponding to the auxiliary diaphragm component, and the auxiliary diaphragm component is fixed to the third bottom wall.

As an improvement, the auxiliary diaphragm component comprises an elastic conductor fixed to the short frames and an auxiliary diaphragm attached to one side of the elastic conductor away from the diaphragm.

As an improvement, the elastic conductor comprises an elastic conductive fixed portion extending towards the diaphragm, and a lead wire of the voice coil is fixed to the elastic conductive fixed portion.

As an improvement, the framework includes first frameworks configured to connect the diaphragm with the voice coil, and the first frameworks are spaced apart from each other to form air gaps.

As an improvement, one side of one of the auxiliary magnet components close to the diaphragm is provided with an avoiding slot recessed towards the yoke.

Compared with the related art, in the sounding device according to the disclosure, the magnetic circuit system includes a yoke, a main magnet component fixedly arranged on the yoke, and auxiliary magnet components respectively arranged on two opposite sides of the main magnet component and spaced apart from the main magnet component to form a magnetic gap. The voice coil is inserted in the magnetic gap. The yoke includes a yoke body, yoke extension walls, and yoke sidewalls. Two opposite sides of the yoke body extend to form the yoke extension walls, respectively, and another two opposite sides of the yoke body are bent and extend toward the diaphragm to form the yoke sidewalls, respectively. The auxiliary magnet components are respectively fixed to the yoke extension walls. The main magnet component is sequentially spaced apart from the auxiliary magnet components and the yoke sidewalls to form the magnetic gap. The positioning bracket is made of a metal material. One side of each of the auxiliary magnet components away from the yoke is fixed to the positioning bracket by laser spot welding. With the structure, a circle of the yoke surrounds the voice coil without avoidance, providing optimal performance. The auxiliary magnet component is fixed to the positioning bracket by laser spot welding, which has good reliability and ensures positioning of the magnetic circuit system in all directions at the same time. Concentricity of the magnetic circuit system is not limited by precision of components, and better product consistency can be obtained by means of high-precision assembly such as image recognition. Meanwhile, the positioning bracket is made of a metal material, which has better mechanical strength and is not prone to be deformed and have defects.

BRIEF DESCRIPTION OF DRAWINGS

In order to more clearly illustrate the technical solutions in embodiments of the disclosure, the accompanying drawings used in the description of the embodiments will be briefly introduced below. The accompanying drawings in the following description illustrates only some embodiments of the disclosure, and other drawings can be obtained by those of ordinary skill in the art from the provided drawings. In the drawings.

DESCRIPTION OF EMBODIMENTS

The technical solutions in the embodiments of the disclosure will be described clearly and completely below with reference to the accompanying drawings in the embodiments of the disclosure. The described embodiments are merely some of rather than all of the embodiments of the disclosure. All other embodiments acquired by those skilled in the art without creative efforts based on the embodiments of the disclosure shall fall within the protection scope of the disclosure.

Figure 1:
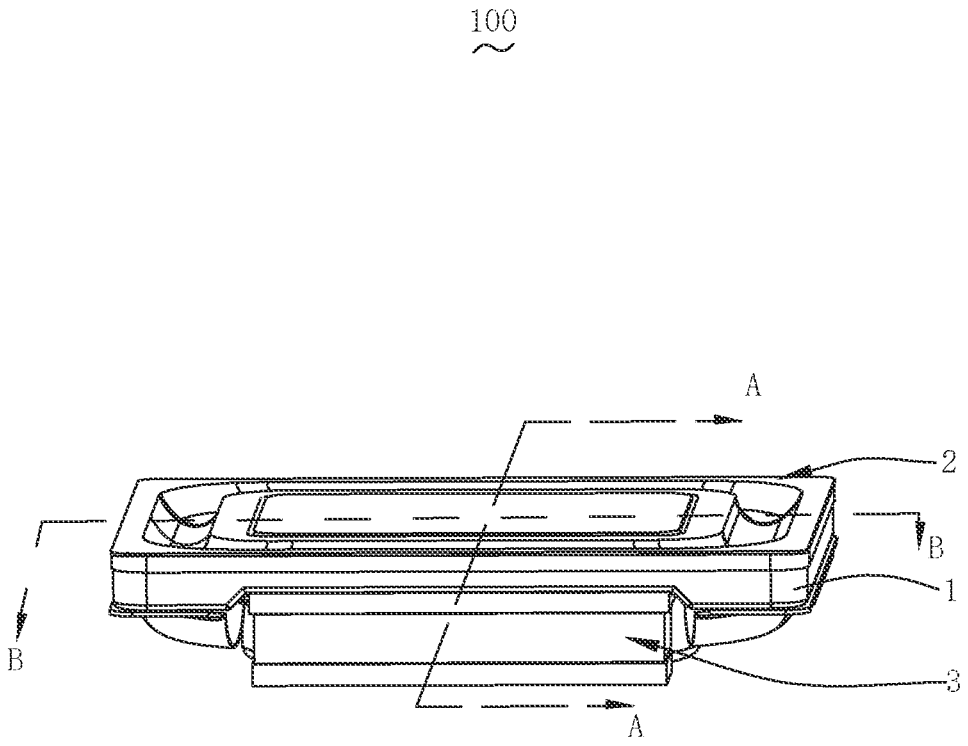
FIG. 1 is a schematic diagram of a three-dimensional structure of a sounding device according to the disclosure.
Figure 2:
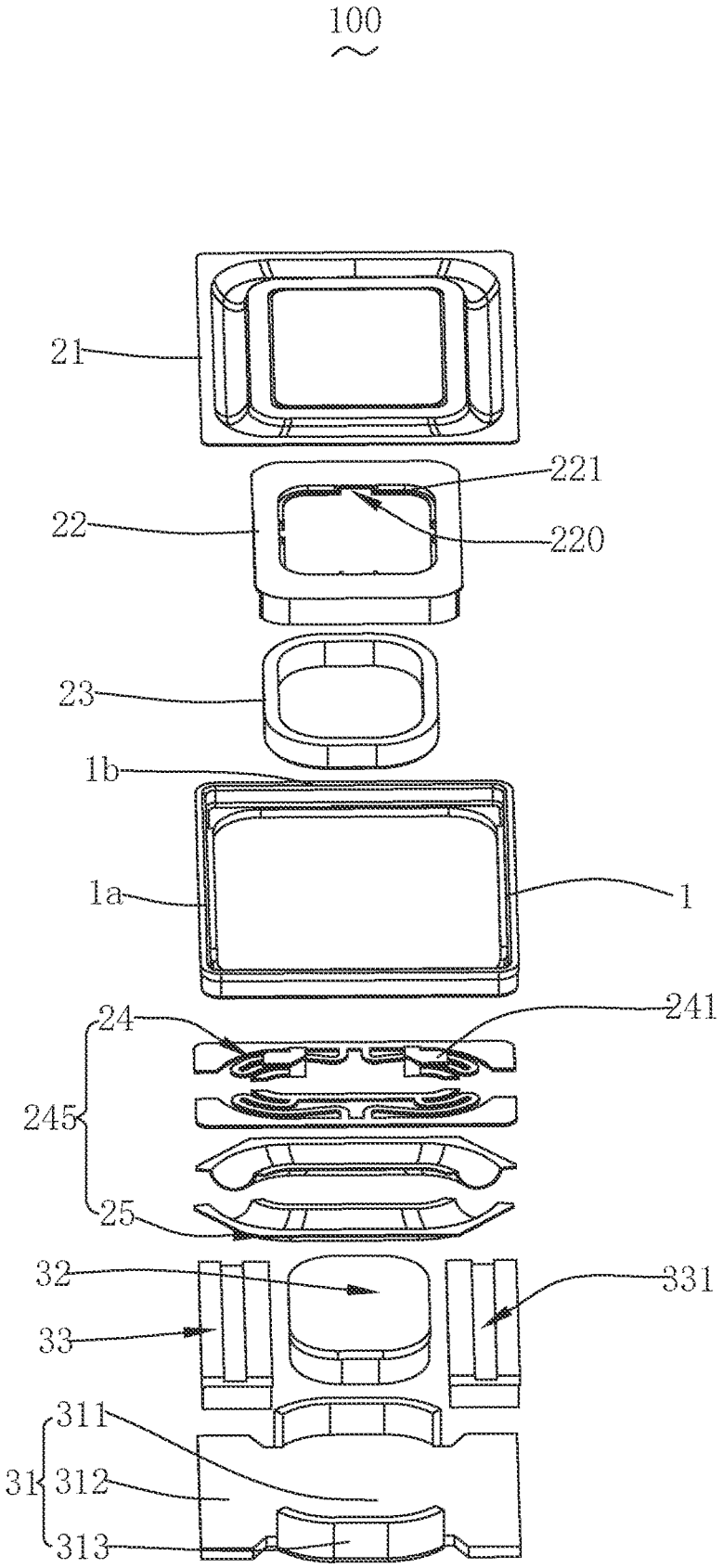
FIG. 2 is a schematic exploded view of a three-dimensional structure of the sounding device according to the disclosure.
Figure 3:
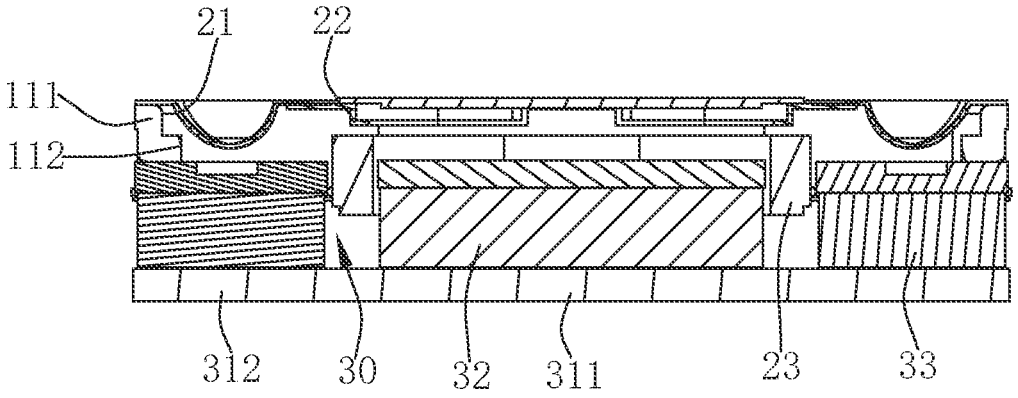
FIG. 3 is a sectional view of the sounding device along line AA according to the disclosure.
Figure 4:
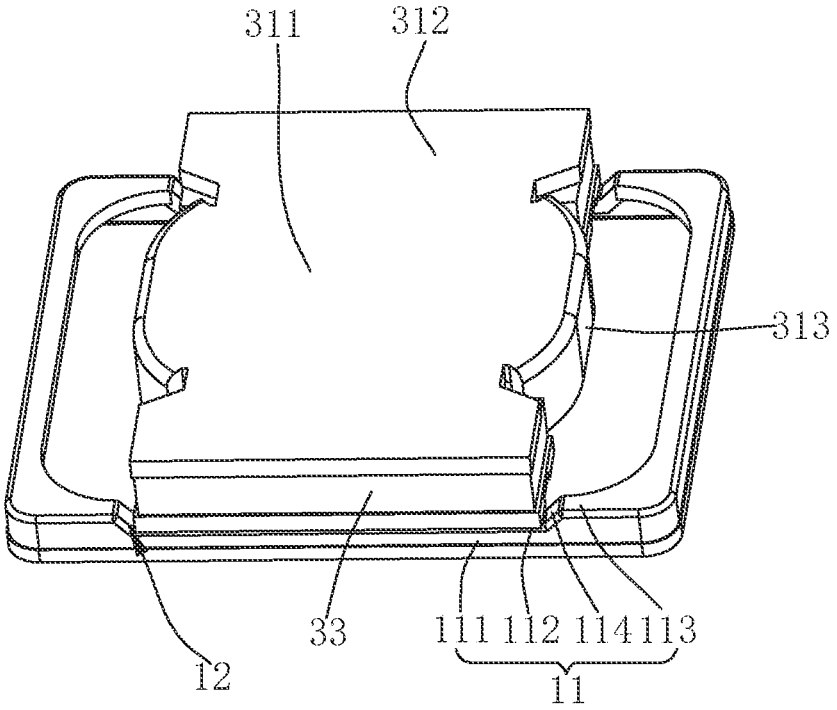
FIG. 4 is a schematic assembled view of a magnetic circuit system and a positioning bracket according to the disclosure.
Figure 5:
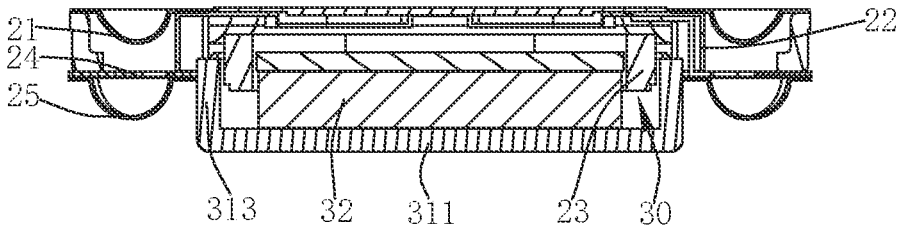
FIG. 5 is a sectional view of the sounding device along line BB according to the disclosure from another perspective.

Referring to FIG. 1 to FIG. 5, the disclosure provides a sounding device 100. The sounding device 100 includes a positioning bracket 1, a vibration system 2 fixed to the positioning bracket 1, and a magnetic circuit system 3 configured to drive the vibration system 2 to vibrate to generate sound. The vibration system 2 includes a diaphragm 21 configured to vibrate to generate sound. The magnetic circuit system 3 has a magnetic gap 30.

In an embodiment, the positioning bracket 1 is made of a metal material, which has better mechanical strength and is not prone to be deformed and have defects. The positioning bracket 1 includes a positioning bracket body 11 configured to support and fix the diaphragm 21, and a positioning slot 12. One side of the positioning bracket body 11 close to the magnetic circuit system 3 is recessed towards the diaphragm 21 to form the positioning slot 12. The positioning bracket 1 is in a rectangular shape and includes two opposite long frames 1*b* and two opposite short frames 1*a*. Two positioning slots 12 are provided and are correspondingly arranged on the two long frames 1*b*, respectively.

In an embodiment, the positioning bracket body 11 includes a ring-shaped first sidewall 111 forming the positioning slot 12, a second bottom wall 112, a third bottom wall 113, and fourth inclined walls 114. A portion of the first sidewall 111 located at the positioning slot 12 is bent and extends towards the yoke 31 to form the second bottom wall 112. An inner side of the first sidewall 111 is bent and extends towards the yoke 31 to form the third bottom wall 113. Two opposite ends of the second bottom wall 112 extend towards the third bottom wall 113 and then are connected to the third bottom wall 113 to form the fourth inclined walls 114, respectively. The second bottom wall 112 and two adjacent fourth inclined walls 114 define the positioning slot 12.

In an embodiment, the vibration system 2 includes a diaphragm 21 fixed to one side of the positioning bracket 1 away from the magnetic circuit system 3, a framework 22 fixed to one side of the diaphragm 21 close to the magnetic circuit system 3, a voice coil 23 inserted in the magnetic gap 30 and an auxiliary diaphragm component 245. The voice coil 23 is fixed to the diaphragm 21 through the framework 22. The auxiliary diaphragm component 245 has one end fixed to one side of the short frame 1*a* away from the diaphragm 21 and the other end elastically supporting the framework 22. The auxiliary diaphragm component 245 is arranged corresponding to the third bottom wall 113. The auxiliary diaphragm component 245 is fixed to the third bottom wall 113. The auxiliary diaphragm component 245 includes an elastic conductor 24 fixed to one side of the short frame 1*a* of the positioning bracket 1 away from the diaphragm 21 and an auxiliary diaphragm 25 attached to one side of the elastic conductor 24 away from the diaphragm 21. The elastic conductor 24 includes an elastic conductive fixed portion 241 extending towards the diaphragm 21. A lead wire of the voice coil 23 is fixed to the elastic conductive fixed portion 241. With the structure, the voice coil 23 can be led out from above, thereby making it unnecessary for the yoke 31 below to make avoidance to facilitate the voice coil 23 to be led out, and the yoke sidewall 313 can wrap around the main magnet component 32 to achieve better magnetic conductivity. The voice coil 23 is fixed to one end of the framework 22 away from the diaphragm 21 to drive the diaphragm 21 to vibrate to generate sound. In an embodiment, the framework 22 includes a first framework 221 configured to connect the diaphragm 21 with the voice coil 23. Multiple first frameworks 221 are provided and spaced apart from each other to form air gaps 220. The structure is conducive to air circulation inside the sound device 100.

The magnetic circuit system 3 includes a yoke 31, a main magnet component 32 fixed to the yoke 31, and auxiliary magnet components 33 respectively arranged on two opposite sides of the main magnet component 32 and spaced apart from the main magnet component 32 to form a magnetic gap 30. One side of the auxiliary magnet component 33 away from the yoke 31 is fixed to the positioning bracket 1 by laser spot welding.

With the structure, the auxiliary magnet component 33 is fixed to the positioning bracket 1 by laser spot welding, which has good reliability and ensures positioning of the magnetic circuit system 3 in all directions at the same time. Concentricity of the magnetic circuit system 3 is not limited by precision of components, and better product consistency can be obtained by means of high-precision assembly such as image recognition. As an improvement, one side of the auxiliary magnet component 33 close to the diaphragm 21 is provided with an avoiding slot 331 recessed towards the yoke 31. The structure can provide an avoiding structure for the diaphragm 21 to prevent structural interference with the auxiliary magnet component 33 when the diaphragm 21 vibrates.

In an embodiment, the yoke 31 includes a yoke body 311, yoke extension walls 312, and yoke sidewalls 313. Two opposite sides of the yoke body 311 extend to form the yoke extension walls 312, respectively, and another two opposite sides of the yoke body 311 are bent and extend toward the diaphragm 21 to form the yoke sidewalls 313. The auxiliary magnet component 33 is fixed to the yoke extension wall 312. The main magnet component 32 is sequentially spaced apart from the auxiliary magnet components 33 and the yoke sidewalls 313 to form the magnetic gap 30. A circle of the yoke 31 surrounds the voice coil 23 without avoidance, providing optimal performance.

In an embodiment, the yoke extension wall 312 is formed by extending along a vibration direction perpendicular to the vibration system 2. The positioning slots 12 are in one-to-one correspondence to the auxiliary magnet components 33. One end of the auxiliary magnet component 33 away from the yoke extension wall 312 is received in the positioning slot 12 and is fixed to a bottom surface of the positioning slot 12 by laser spot welding. For example, a spacing distance between the second bottom wall 112 and the yoke body 311 is greater than a spacing distance between the third bottom wall 113 and the yoke body 311, and one end of the auxiliary magnet component 33 away from the yoke extension wall 312 is fixed to the second bottom wall 112 by laser spot welding. With such configuration, structure layout of the sounding device 100 is more reasonable. For example, the auxiliary magnet component 33 is received in the positioning slot 12, and the elastic conductor 24 is fixed to the short frame 1*a* of the positioning bracket 1, which has a higher space utilization rate.

Compared with the related art, in the sounding device according to the disclosure, the magnetic circuit system includes the yoke, the main magnet component fixedly arranged on the yoke, and the auxiliary magnet components respectively arranged on two opposite sides of the main magnet component and spaced apart from the main magnet component to form a magnetic gap. The voice coil is inserted in the magnetic gap. The yoke includes the yoke body, the yoke extension walls, and yoke sidewalls. Two opposite sides of the yoke body extend to form the yoke extension walls, respectively, and another two opposite sides of the yoke body are bent and extend toward the diaphragm to form the yoke sidewalls, respectively. The auxiliary magnet component is fixe to the yoke extension wall. The main magnet component is sequentially spaced apart from the auxiliary magnet component and the yoke sidewall to form the magnetic gap. The positioning bracket is made of the metal material. One side of the auxiliary magnet component away from the yoke is fixed to the positioning bracket by laser spot welding. With such structure, a circle of the yoke surrounds the voice coil without avoidance, providing optimal performance. The auxiliary magnet component is fixed to the positioning bracket by laser spot welding, which has good reliability and ensures positioning of the magnetic circuit system in all directions at the same time. Concentricity of the magnetic circuit system is not limited by precision of components, and better product consistency can be obtained by means of high-precision assembly such as image recognition. Meanwhile, the positioning bracket is made of a metal material, which has better mechanical strength and is not prone to be deformed and have defects.

The above illustrates only some embodiments of the disclosure and thus not intended to limit the patent scope of the disclosure. All equivalent structures or equivalent flow transformations made by virtue of contents of the specification and the drawings of the disclosure or direct or indirect application of the contents to the other related technical fields shall fall within the protection scope of the disclosure.

What is claimed is:

1. A sounding device, comprising:

a positioning bracket, a vibration system fixed to the positioning bracket, wherein the vibration system comprises a diaphragm fixed to the positioning bracket and a voice coil configured to drive the diaphragm to vibrate; and a magnetic circuit system configured to drive the vibration system to vibrate to generate sound, wherein the magnetic circuit system comprises a yoke, a main magnet component fixed to the yoke, and auxiliary magnet components arranged at two opposite sides of the main magnet component and spaced apart from the main magnet component to form a magnetic gap, and the voice coil is inserted in the magnetic gap; the yoke comprises a yoke body, yoke extension walls, and yoke sidewalls, wherein two opposite sides of the yoke body extend to form the yoke extension walls, respectively, and another two opposite sides of the yoke body are bent and extend toward the diaphragm to form the yoke sidewalls, respectively; and the auxiliary magnet components are respectively fixed to the yoke extension walls, and the main magnet component is sequentially spaced apart from the auxiliary magnet components and the yoke sidewalls to form the magnetic gap; and the positioning bracket is made of a metal material, and one side of each of the auxiliary magnet components away from the yoke is fixed to the positioning bracket by laser spot welding.

2. The sounding device as described in claim 1, wherein each of the yoke extension walls is formed by extending along a vibration direction perpendicular to the vibration system.

3. The sounding device as described in claim 1, wherein the positioning bracket comprises a positioning bracket body and positioning slots, wherein sides of the positioning bracket body close to the magnetic circuit system are recessed towards the diaphragm to form the positioning slot, respectively, the positioning slots are in one-to-one correspondence to the auxiliary magnet components, and one end of one of the auxiliary magnet components away from one of the yoke extension walls is received in one positioning slot of the positioning slots and is fixed to a bottom surface of the one positioning slot by laser spot welding.

4. The sounding device as described in claim 3, wherein the positioning bracket is in a rectangular shape and comprises two long frames opposite to each other and two short frames opposite to each other, the positioning slots are arranged on the long frames, the vibration system further comprises a framework fixed to one side of the diaphragm close to the magnetic circuit system and an auxiliary diaphragm component, and the voice coil is fixed to the diaphragm through the framework; and the auxiliary diaphragm component has one end fixed to one side of one of the long frames away from the diaphragm and another end elastically supporting the framework.

5. The sounding device as described in claim 4, wherein the positioning bracket body comprises a first sidewall in a ring shape and forming the positioning slots, a second bottom wall, a third bottom wall, and fourth inclined walls, wherein a portion of the first sidewall located at each of the positioning slots is bent and extends towards the yoke to form the second bottom wall; an inner side of the first sidewall is bent and extends towards the yoke to form the third bottom wall; and two opposite ends of the second bottom wall extend towards the third bottom wall and then are connected to the third bottom wall to form the fourth inclined walls, respectively; a spacing distance between the second bottom wall and the yoke body is greater than a spacing distance between the third bottom wall and the yoke body, the second bottom wall and two adjacent ones of the fourth inclined walls define one of the positioning slots, and one end of one of the auxiliary magnet components away from one of the yoke extension walls is fixed to the second bottom wall by laser spot welding; and the third bottom wall is arranged corresponding to the auxiliary diaphragm component, and the auxiliary diaphragm component is fixed to the third bottom wall.

6. The sounding device as described in claim 5, wherein the auxiliary diaphragm component comprises an elastic conductor fixed to the short frames and an auxiliary diaphragm attached to one side of the elastic conductor away from the diaphragm.

7. The sounding device as described in claim 6, wherein the elastic conductor comprises an elastic conductive fixed portion extending towards the diaphragm, and a lead wire of the voice coil is fixed to the elastic conductive fixed portion.

8. The sounding device as described in claim 4, wherein the framework comprises first frameworks configured to connect the diaphragm with the voice coil, wherein the first frameworks are spaced apart from each other to form air gaps.

9. The sounding device as described in claim 1, wherein one side of one of the auxiliary magnet components close to the diaphragm is provided with an avoiding slot recessed towards the yoke.

* * * * *